US009872548B2

(12) United States Patent
Ma

(10) Patent No.: US 9,872,548 B2
(45) Date of Patent: Jan. 23, 2018

(54) BAG APPARATUS

(71) Applicant: Yan Ma, Charlotte, NC (US)

(72) Inventor: Yan Ma, Charlotte, NC (US)

( * ) Notice: Subject to any disclaimer, the term of this patent is extended or adjusted under 35 U.S.C. 154(b) by 0 days.

(21) Appl. No.: 14/885,346

(22) Filed: Oct. 16, 2015

(65) Prior Publication Data

US 2016/0066670 A1 Mar. 10, 2016

Related U.S. Application Data

(63) Continuation-in-part of application No. 29/513,388, filed on Dec. 30, 2014, now Pat. No. Des. 759,961.

(60) Provisional application No. 61/941,255, filed on Feb. 18, 2014.

(51) Int. Cl.

| | |
|---|---|
| ***A45C 13/30*** | (2006.01) |
| ***A45F 3/02*** | (2006.01) |
| ***A45F 3/04*** | (2006.01) |
| *A45C 3/00* | (2006.01) |
| *A45F 3/00* | (2006.01) |

(52) U.S. Cl.

CPC ..... *A45C 13/30* (2013.01); *A45F 3/02* (2013.01); *A45F 3/04* (2013.01); *A45C 3/001* (2013.01); *A45F 2003/002* (2013.01); *A45F 2003/006* (2013.01); *A45F 2003/008* (2013.01)

(58) Field of Classification Search

CPC ..... A45C 13/30; A45C 13/103; A45C 3/001; Y10S 383/907

USPC ..... 224/625, 623; 150/100, 110, 111; 383/907

See application file for complete search history.

(56) References Cited

U.S. PATENT DOCUMENTS

| | | | | |
|---|---|---|---|---|
| 4,776,546 | A * | 10/1988 | Goldson | A61J 9/00 224/148.4 |
| 5,437,403 | A * | 8/1995 | Lemanski, II | A45F 3/02 224/603 |
| 5,687,896 | A * | 11/1997 | Clift | A45F 5/00 224/587 |
| 5,991,925 | A * | 11/1999 | Wu | A41D 13/0012 2/102 |
| 6,237,660 | B1 | 5/2001 | Giardino | |
| 6,325,262 | B1 * | 12/2001 | Thompson | A45F 3/04 224/153 |
| 7,607,461 | B2 | 10/2009 | Pace et al. | |
| 8,156,974 | B2 | 4/2012 | Pace et al. | |
| 8,240,532 | B2 * | 8/2012 | Cragg | A45F 3/08 224/648 |
| 8,328,058 | B2 * | 12/2012 | Wilson | A45F 3/005 224/243 |
| 8,403,011 | B1 | 3/2013 | McKendry | |
| 8,479,958 | B1 * | 7/2013 | Swift | A45F 3/02 224/257 |

(Continued)

*Primary Examiner* — Sue A Weaver

(74) *Attorney, Agent, or Firm* — The Law Firm of Andrea Hence Evans, LLC

(57) ABSTRACT

The present invention discloses, inter alia, a bag apparatus having a main body with different portions. Aspects of embodiments of the invention contemplate the apparatus having side portions and curved ends that enable the apparatus to hug the contours of a user and efficiently distribute the weight of the apparatus and contents thereby relieving pressures and stresses normally encountered with contemporary bags. Additional aspects contemplate straps to enable the apparatus to be carried by a user in a number of ways.

13 Claims, 10 Drawing Sheets

(56) References Cited

U.S. PATENT DOCUMENTS

| | | | | |
|---|---|---|---|---|
| 8,668,122 | B2 * | 3/2014 | Case | A45F 3/02 224/218 |
| 8,684,053 | B2 | 4/2014 | Platt et al. | |
| 8,960,511 | B2 * | 2/2015 | Shepherd | A45C 3/00 224/259 |
| 2006/0021684 | A1 | 2/2006 | DeCoro | |
| 2007/0057002 | A1 * | 3/2007 | Timm | A45F 3/02 224/625 |
| 2007/0102077 | A1 | 5/2007 | Parker-Ogden | |
| 2007/0209742 | A1 | 9/2007 | Morgan | |
| 2007/0295772 | A1 * | 12/2007 | Woodmansee | F41H 1/02 224/576 |
| 2009/0050246 | A1 * | 2/2009 | Godshaw | A45F 3/02 150/108 |
| 2010/0218862 | A1 | 9/2010 | Ellermeyer | |
| 2012/0103481 | A1 | 5/2012 | Nieves | |
| 2012/0241059 | A1 | 9/2012 | Wilson | |
| 2014/0150936 | A1 | 6/2014 | Goodale | |

* cited by examiner

BAG APPARATUS

CROSS-REFERENCE TO RELATED APPLICATIONS

This application claims the benefit of, and is related to, Applicant's following patent applications: U.S. Provisional Patent Application No. 61/941,255 titled "BAG WEARABLE IN A PLURALITY OF CONFIGURATIONS BASED ON STRAP CONFIGURATION" filed Sep. 25, 2014, and U.S. patent application Ser. No. 29/513,388 filed Dec. 30, 2014, which issued as U.S. Pat. No. D759,961, both of which are incorporated herein in their respective entireties.

FIELD OF THE INVENTION

The present invention relates, in general, to a bag apparatus, in particular to an efficient weight distribution bag apparatus.

BACKGROUND OF THE INVENTION

Different bags or bag systems enable the use of a strap over a person's shoulder. However, because the weight of the bag is generally isolated onto the person's shoulder, the person would normally experience shoulder pain at the shoulder in questions, especially when the bag being carried has been loaded with items, goods etc. In addition, certain bags, because they are not properly secured to the person (e.g. lady hand bags that are merely slung over the lady's shoulder), they are targets for thefts whereby the thieves easily lift the bags off the person's shoulder to effect the theft. As such, there exists a need for a bag that alleviates the stress and pain on a person's shoulders. There is also a need for a bag, at the same time that could be used securely, thereby thwarting or preventing its theft.

SUMMARY OF THE INVENTION

A bag apparatus, which may include a main body bordered by a slightly rounded base portion, a top portion, opposite the base portion, where the top portion may be concave in shape, a first side portion between the base and top portions and a second side portion, opposite the first side portion where both the first and second side portions have oppositely concave shapes, a first curved end, extending away from the main body, where the first curved end may be formed by a first portion of the base portion and a lower portion of the first side portion of the apparatus.

The bag apparatus may also include a second curved end, extending away from the main body, where the second curved end may be formed by a second portion of the base portion and a lower portion of the second side portion of the apparatus, a third curved end, extending away from the main body, where the third curved end may be formed by a first portion of the top portion and the upper portion of the first side portion, and a fourth curved end, where the fourth curved end may be formed by a second portion of the top portion and an upper portion of the second side portion, where the fourth curved end extends further away from the main body than any of the first, second or third curved ends. The bag apparatus in another aspect of an embodiment of the present invention, may also include a compartment portion, superimposedly attached to the main body (or on top of the main body), where the compartment portion may include compartment(s). The attachment may be permanent or one that may be detachable.

In an aspect of an embodiment of the present invention the ends of the bag apparatus may be convex in shape. In another aspect, the ends may have the shape of flaps.

In an aspect of an embodiment of the present invention the ends of the bag apparatus may rounded in shape.

In an aspect of an embodiment of the present invention, the bag apparatus may further include a first detachable strap having ends that are attached at the first and second curved ends.

In an aspect of an embodiment of the present invention, the bag apparatus may further include a second detachable strap include of two sub-straps with the first sub-straps having an end capable of being attached at the third curved end and the second sub-strap having an end capable of being attached to the fourth curved end, where both sub-straps are releasably connected by way of their other respective ends with each other with a connector.

In an aspect of an embodiment of the present invention, the compartment(s) of the bag apparatus may further include a closing flap.

In an aspect of an embodiment of the present invention, each of the compartment(s) of the bag apparatus may further include a closing zipper.

In an aspect of an embodiment of the present invention, the compartment portion of the bag apparatus may be detachable from the main body.

In an aspect of an embodiment of the present invention, the compartment(s) may include a releasably detachable section. In one aspect of an embodiment of the present invention, the releasably detachable section may be attached within a pouch of the compartment portion. This attachment may be enabled using a number of attachment mechanisms including, without limitation, hooks, mating Velcro strips, click and connect mechanisms, etc.

In an aspect of an embodiment of the present invention, the bag apparatus may further include a flash light holder.

In an aspect of an embodiment of the present invention, the second detachable strap of the bag apparatus may be adjustable to enable weight distribution and comfortable placement of the bag apparatus. For instance, upon an appropriate extension of the second detachable strap, the bag apparatus will be able to be located around or slightly above the thigh of the user. At this height/location, the first detachable strap may be fastened around the user's thighs with the bag apparatus thereby "hugging" the user's thigh. In locating the bag apparatus at the user's thigh and by extending the second detachable strap to do so, the weight of the bag apparatus (and its contents, if loaded) is effectively distributed thereby alleviating stress or weight on the user's shoulders as experienced by users of contemporary bag systems.

Additional aspects, objectives, features and advantages of the present invention will become apparent from the following description of the preferred embodiments with reference to the attached drawings.

BRIEF DESCRIPTION OF THE DRAWINGS

FIGS. 1E-1-1E-10 illustrate a bag apparatus showing exchangeable covers of the compartment portion of the bag apparatus according to aspects of embodiments of the present invention.

FIGS. 1G-1-1G-3 illustrate a flash light holder of the bag apparatus according to aspects of embodiments of the present invention.

FIGS. 2A-2C-2 illustrate different ways by which the bag apparatus could be carried by a user according to aspects of embodiments of the present invention.

DETAILED DESCRIPTION OF THE INVENTION

Figure 1A:
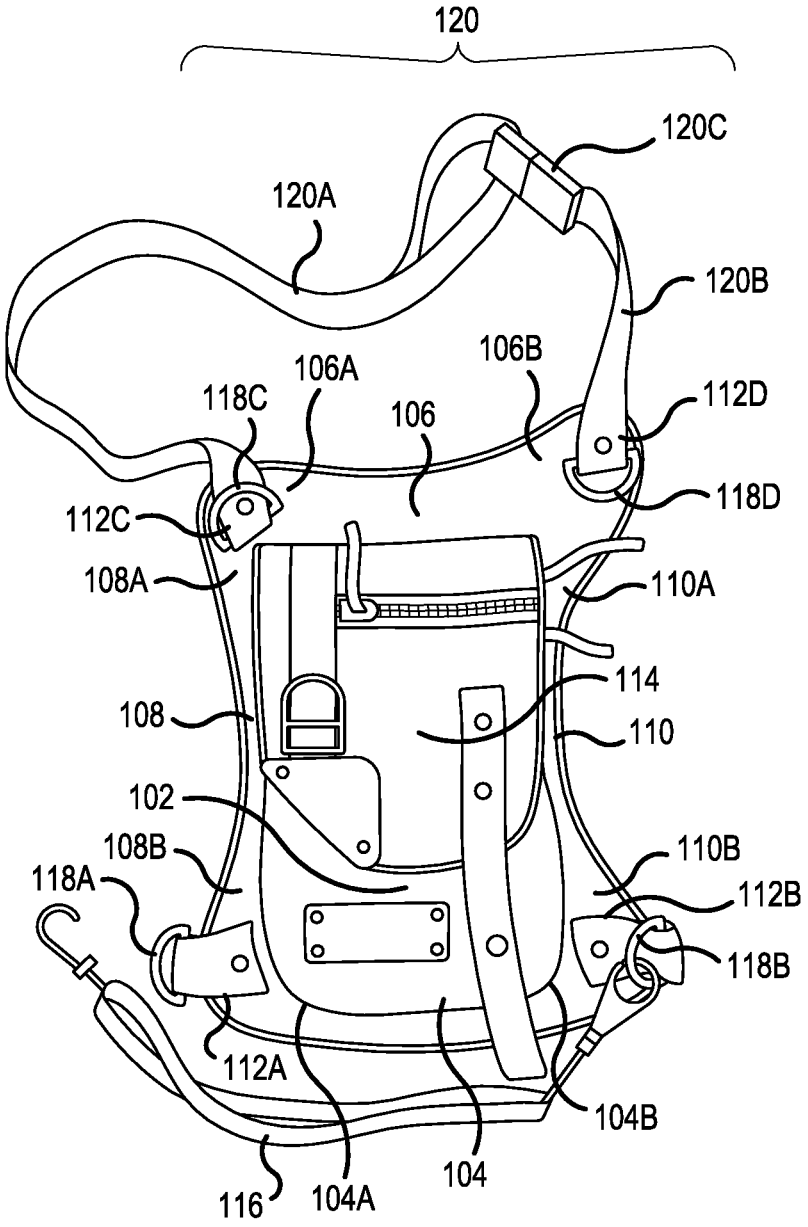
FIG. 1A illustrates a bag apparatus according to an aspect of an embodiment of the present invention.
Figure 1B:
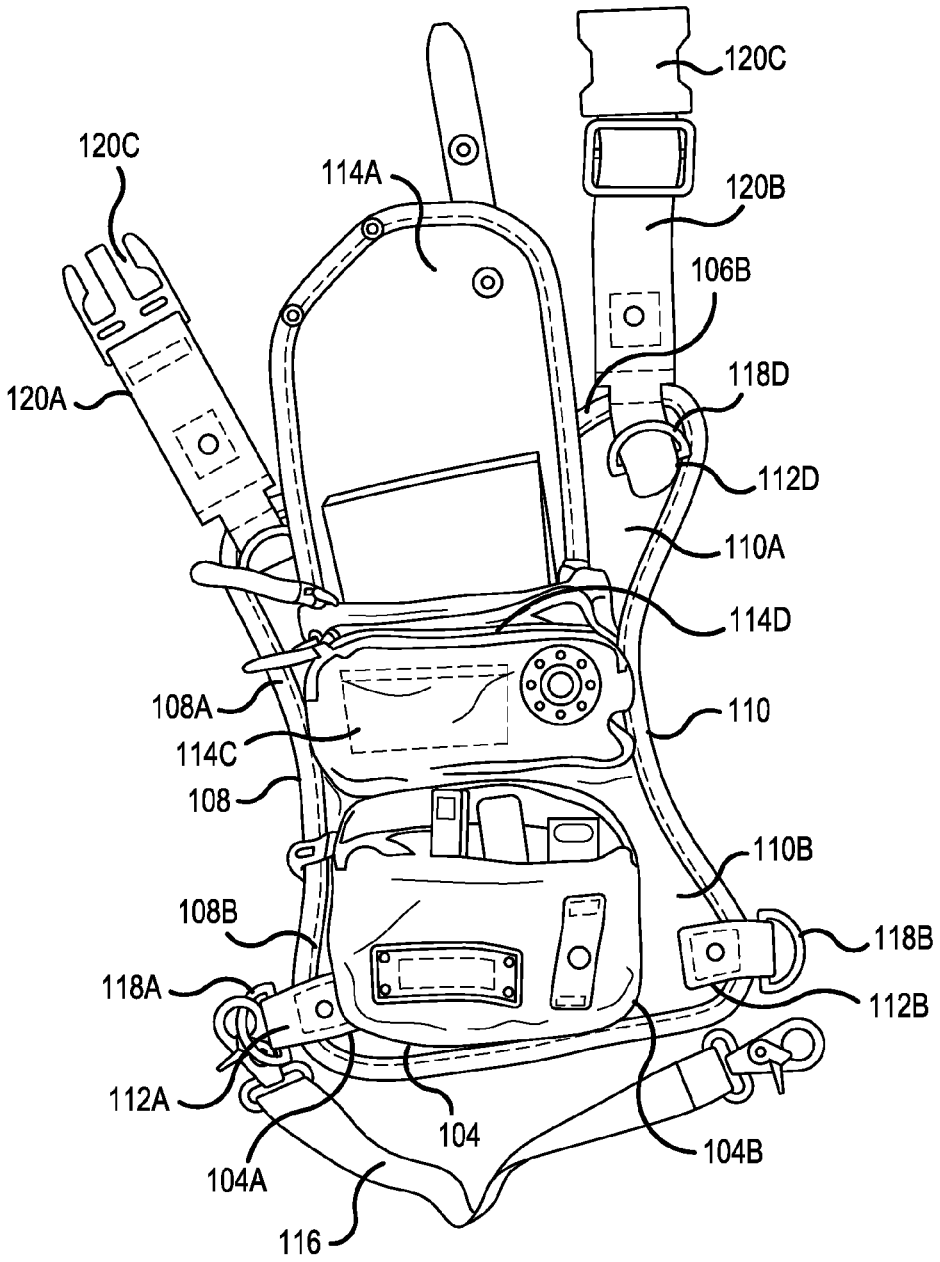
FIG. 1B illustrates a bag apparatus showing a flap according to an aspect of an embodiment of the present invention.

Referring now to FIGS. 1A through 1G-3, different parts or elements of bag apparatus 100 are shown according to aspects of embodiments of the present invention. Bag apparatus 100 may include a main body 102 which may be bordered by a base portion 104 and a top portion 106 where base portion 104 and top portion 106 are opposite each other. In an aspect of an embodiment of the present invention, base portion and top portion 106 may be slightly curved. In another aspect they may be concave in shape. In yet another aspect of an embodiment of the present invention, they may both be curved in the same configuration.

Bag apparatus 100 may also include a first side portion 108 between base and top portions 104 and 106 and a second side portion 110, opposite first side portion 108 where both first and second side portions 108 and 110 may, in one aspect of an embodiment of the present invention, have oppositely concave shapes. Bag apparatus 100 may also include a first curved end 112A extending away from main body 102, where first curved end 112A may be formed by a first portion 104A of base portion 104 and a lower portion 108B of first side portion 108.

Bag apparatus 100 may also include a second curved end 112B, extending away from main body 102, where second curved end 112B may be formed by a second portion 104B of base portion 104 and a lower portion 110B of second side portion 110 of apparatus 100. Bag apparatus 100 may also include a third curved end 112C, extending away from main body 102, where third curved end 112C may be formed by a first portion 106A of top portion 106 and upper portion 108A of the first side portion, and a fourth curved end 112D, where fourth curved end 112D may be formed by a second portion 106B of top portion 106 and an upper portion 110A of second side portion 110, where fourth curved end 112D extends further away from main body 102 than any of the first, second or third curved ends 112A-C.

In an aspect of an embodiment of the present invention, curved ends 112A through D are formed by extensions of the different sides, bases, top portions of bag apparatus 100. Bag apparatus 100 in another aspect of an embodiment of the present invention, may also include compartment portion 114 located over main body 102. In one aspect of an embodiment of the present invention, the compartment portion 114 may be, superimposedly attached to main body 102 (or on top of main body 102), where compartment portion 114 may include compartment(s). This attachment may be permanent or one that may be detachable.

In an aspect of an embodiment of the present invention the curved ends 112A through D of bag apparatus 100 may be convex in shape. In another aspect, curved ends 112A through D may have the shape of flaps. In another aspect of an embodiment of the present invention curved ends 112A through D of bag apparatus 100 may be rounded in shape.

Curved ends 112A through 112D, in an aspect of an embodiment of the present invention, may include or may have attachment ends or anchors 118A through 118D to which straps of bag apparatus 100 may be attached to. In an aspect of an embodiment of the present invention, bag apparatus 100 may further include a first detachable strap 116 having ends that are attached at anchors 118A and 118B of first and second curved ends 112A and 112B.

In an aspect of an embodiment of the present invention, bag apparatus 100 may further include a second detachable strap 120 which, in one aspect of an embodiment of the present invention, may itself include two sub-straps with first sub-strap 120A having an end capable of being attached at anchor 118C of third curved end 112C. Strap 120 may also, in another aspect, include second sub-strap 120B having an end capable of being attached to anchor 118D of fourth curved end 112D. In an aspect of an embodiment of the present invention, both sub-straps 120A and 120B may be releasably connected by way of their other respective ends with each other with a connector 120C.

In an aspect of an embodiment of the present invention, bag apparatus 100 may have any one of curved ends 112A through 112D extend and form an actual strap the may be buckled with another end thereby forgoing the separate strap embodiment.

In an aspect of an embodiment of the present invention, the compartment(s) of compartment portion 114 of bag apparatus 100 may further include closing flap 114A. Flap 114A may be used to cover different compartment(s) of compartment portion 114. In an aspect of an embodiment of the present invention, each of the compartment(s) of bag apparatus 100 may further include a closing zipper 114B. In another aspect of an embodiment of the present invention, the compartment portion 114 of bag apparatus 100 may be detachable from main body 102.

In another aspect of an embodiment of the present invention, the compartment(s) may include a releasably detachable section 114C. In one aspect of an embodiment of the present invention, releasably detachable section 114C may be attached within a pouch 114D of compartment portion 114. This attachment may be enabled or made possible using a number of attachment mechanisms including, without limitation, hooks, mating Velcro strips, click and connect mechanisms, etc. Releasably detachable section 114C may, in one aspect of an embodiment of the present invention, serve as a compartment or pouch for a user's passport, credit cards etc.

Compartment portion 114 of bag apparatus may also include exchangeable covers 114E each of which may have either or both aesthetic or functional capabilities. For instance, one exchangeable cover 114E may be adapted to receive a hunting knife, a firearm, and/or hiking equipment, etc. In another embodiment, exchangeable cover 114E may just serve to add another aesthetic feature to bag apparatus 100. Compartment portion 114 may have a number of compartment(s) that are properly organized thereby enabling a user to organize his/her contents.

In an aspect of an embodiment of the present invention, exchangeable cover(s) 114E may be attached to different locations of bag apparatus 100 to serve different functions. In another aspect of an embodiment of the present invention, exchangeable cover(s) 114E may be folded in half to function as a small wallet. In a further aspect, exchangeable cover(s) 114E may include a leather attachment piece 114F that enables its attachment to main body 102, compartment portion 114 or other attachment points of bag apparatus 100.

Figures 1, 1C, 2:
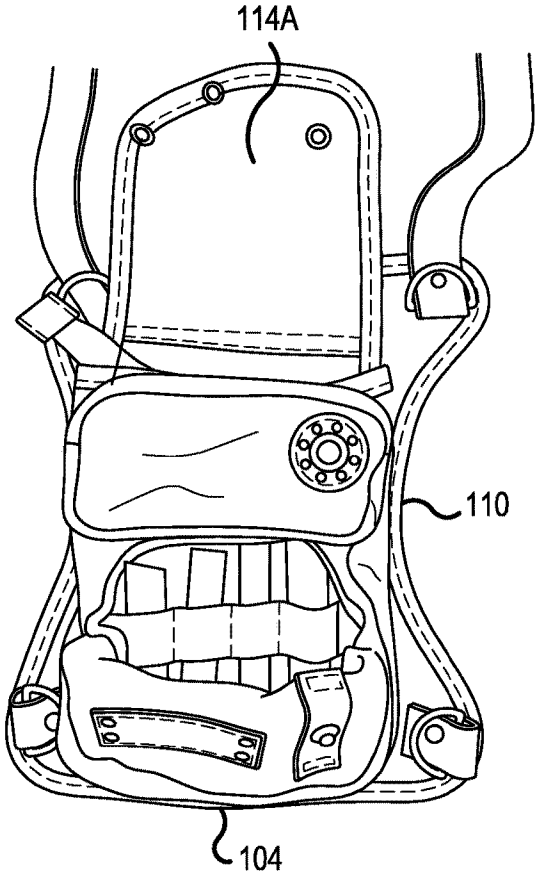
FIGS. 1C-1 and 1C-2 illustrate a bag apparatus showing a flap and different compartments within a compartment portion of the bag apparatus according to aspect of embodiments of the present invention.
Figures 1, 1C:
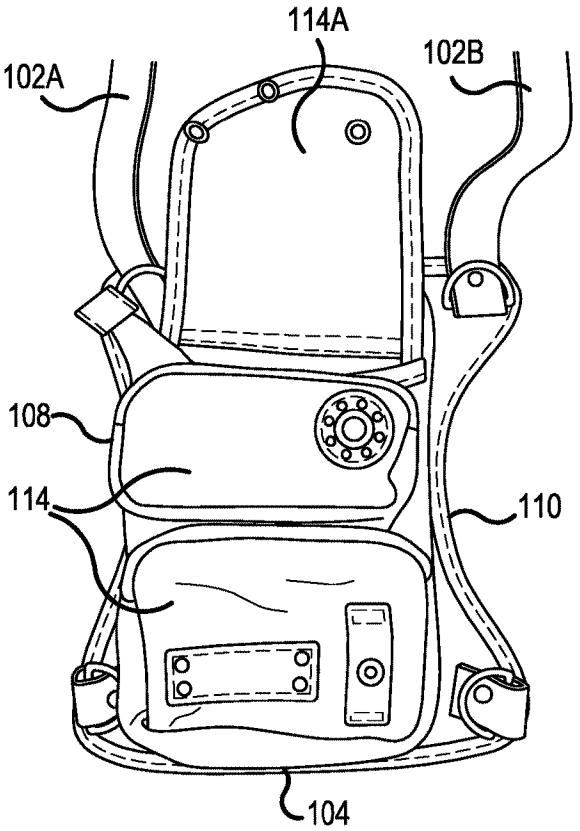
Figure 1D:
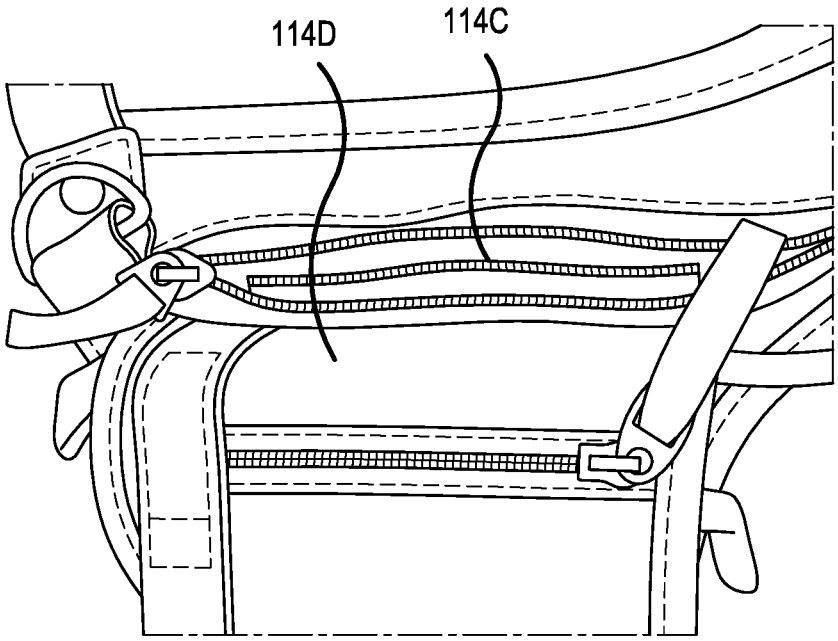
FIG. 1D illustrates a bag apparatus showing a detachable portion of the compartment portion of the bag apparatus according to an aspect of an embodiment of the present invention.
Figures 1, 1E:
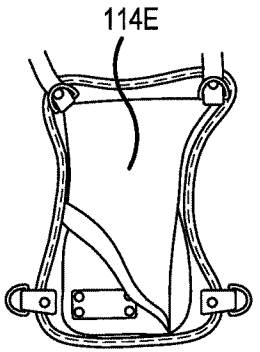
Figures 1, 1E, 2:
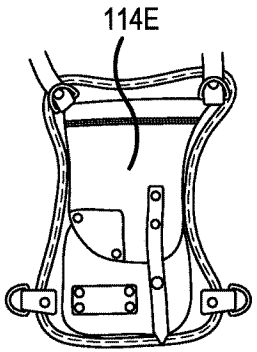
Figures 1, 1E, 2, 3:
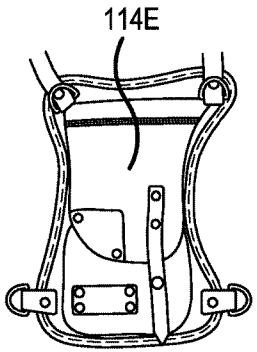
Figures 1, 1E, 2, 3, 4:
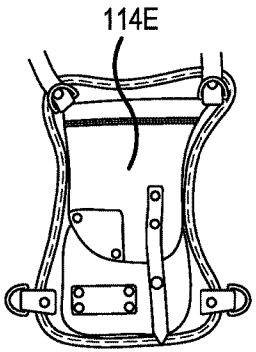
Figures 1, 1E, 2, 3, 4, 5:
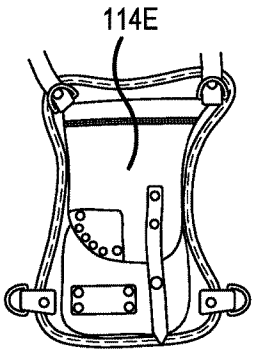
Figures 1, 1E, 2, 3, 4, 5, 6:
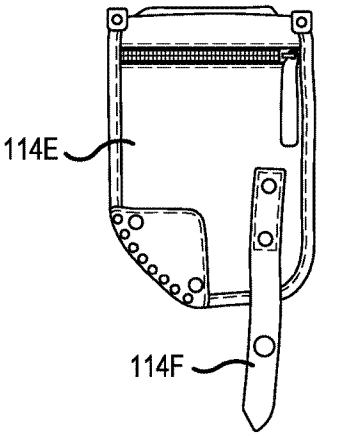
Figures 1, 1E, 2, 3, 4, 5, 6, 7:
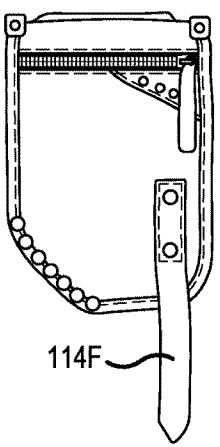
Figures 1, 1E, 2, 3, 4, 5, 6, 7, 8:
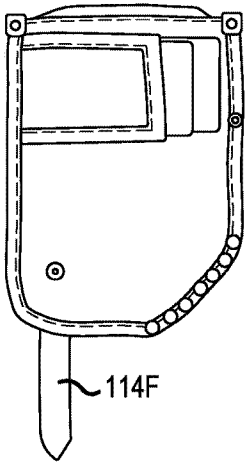
Figures 1, 1E, 2, 3, 4, 5, 6, 7, 8, 9:
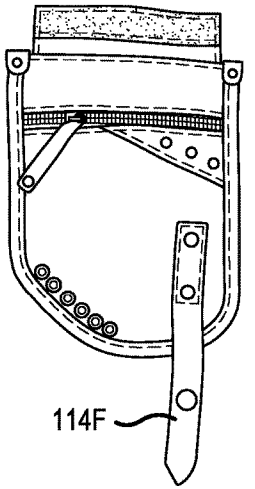
Figures 1, 1E, 2, 3, 4, 5, 6, 7, 8, 9, 10:
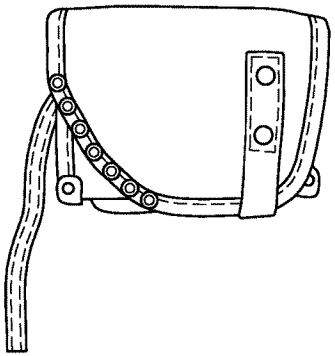
Figure 1F:
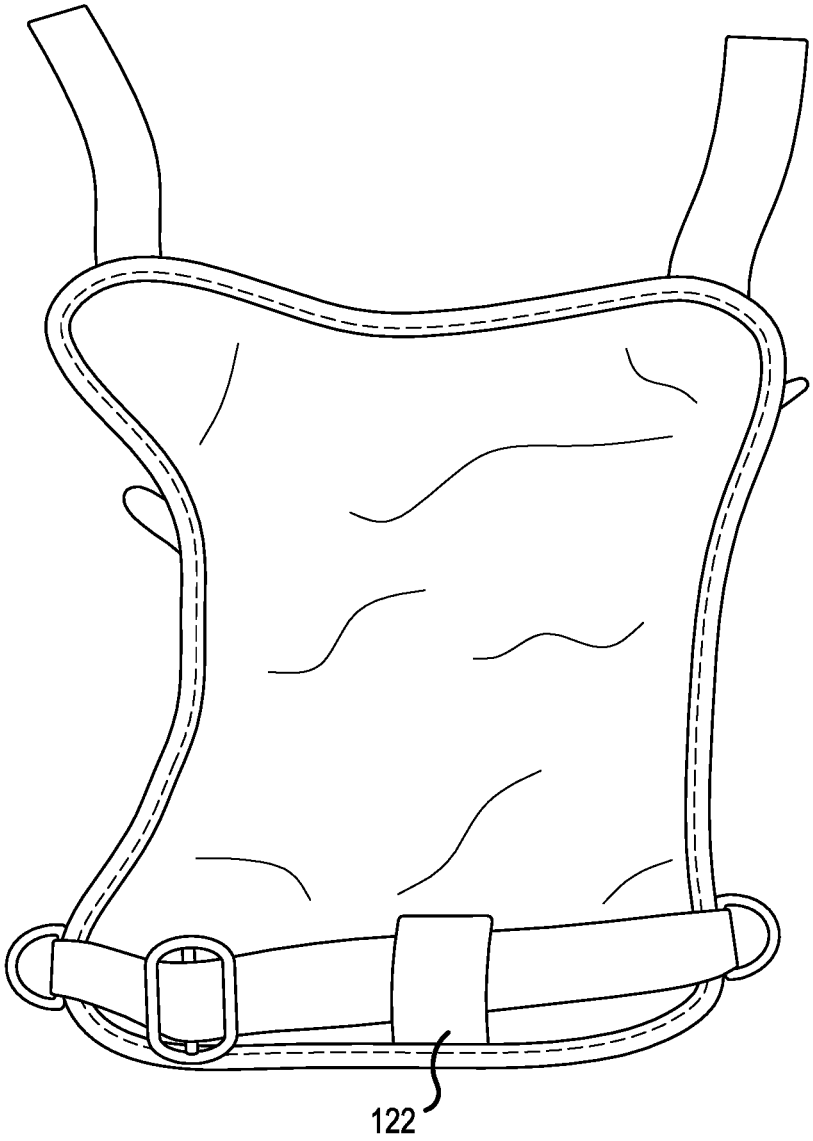
FIG. 1F illustrates different attachment positions of a strap of the bag apparatus according to aspects of embodiments of the present invention.
Figures 1, 1G, 2:
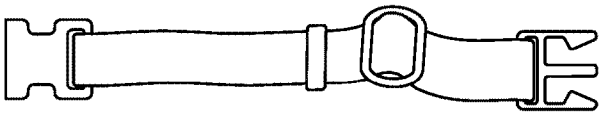
Figures 1, 1G, 2, 3:
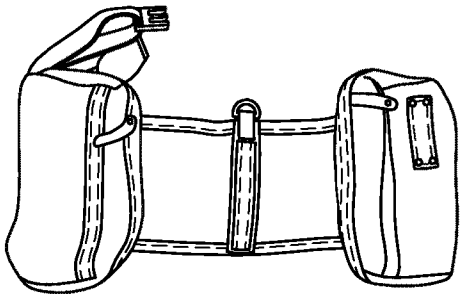
Figures 1, 1G:
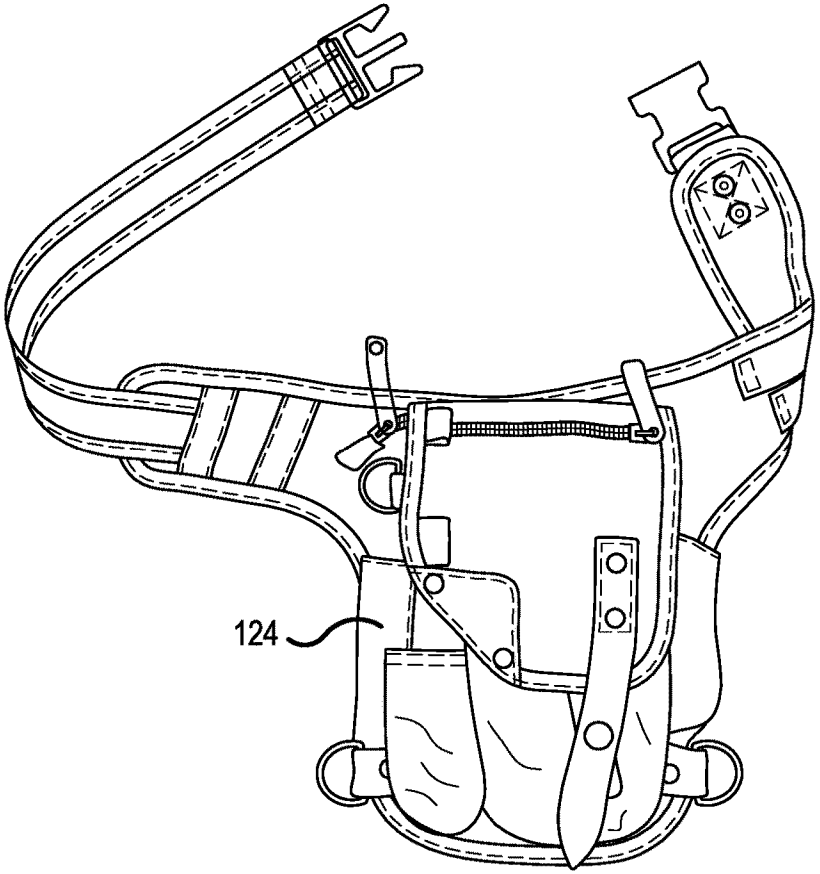

First detachable strap 116 may be attached a number of ways depending on the desired application/use as shown in FIG. 1F. In one aspect of an embodiment of the present invention, first detachable strap 116 may be stowed away in strap holder 122 which, in one aspect, may be located on the backside of bag apparatus 100.

In an aspect of an embodiment of the present invention, bag apparatus 100 may further include a flash light holder 124. The holder 124 may be adapted to tilt and hold a flash light in a certain position to enable a user to point and use the flash light without having to hold it. In one aspect of an embodiment of the present invention, flash light holder 124 may have a net design.

Figure 2A:
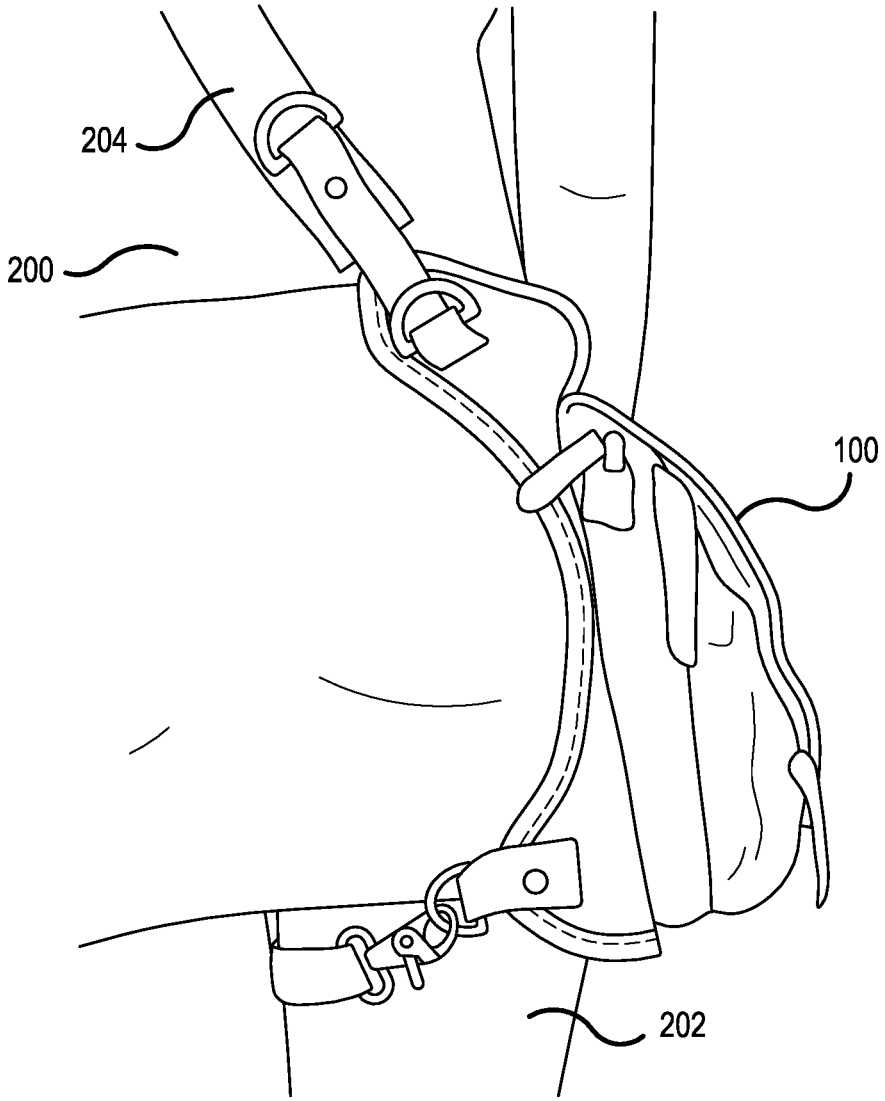
Figures 1, 2B:
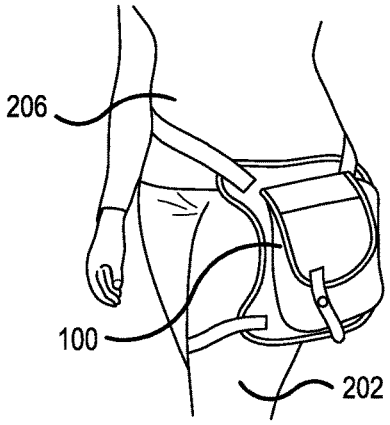
Figures 2, 2B:
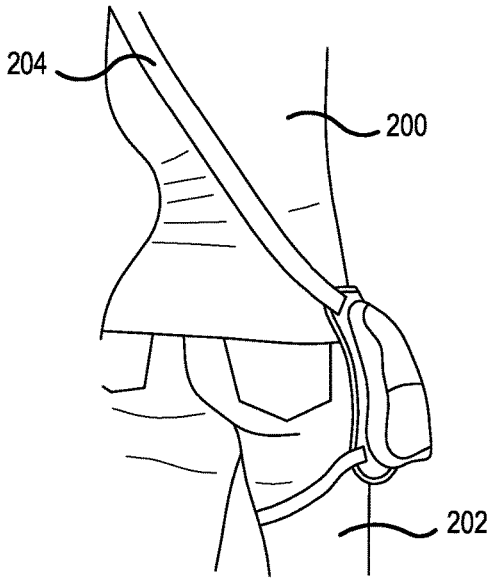
Figures 2, 2B, 3:
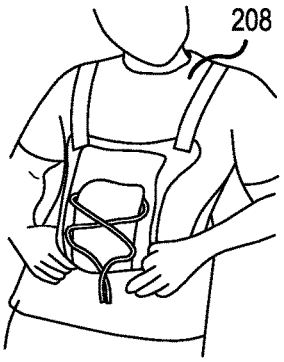
Figures 2, 2B, 3, 4:
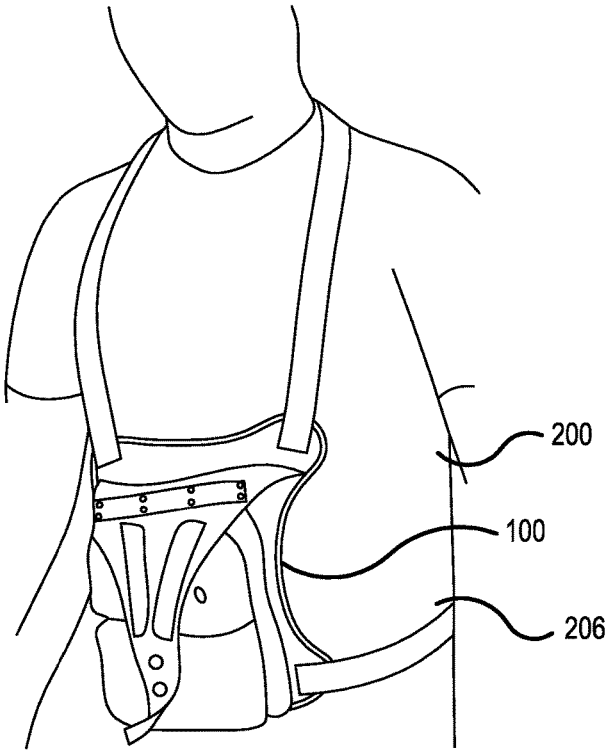
Figures 2, 2C:
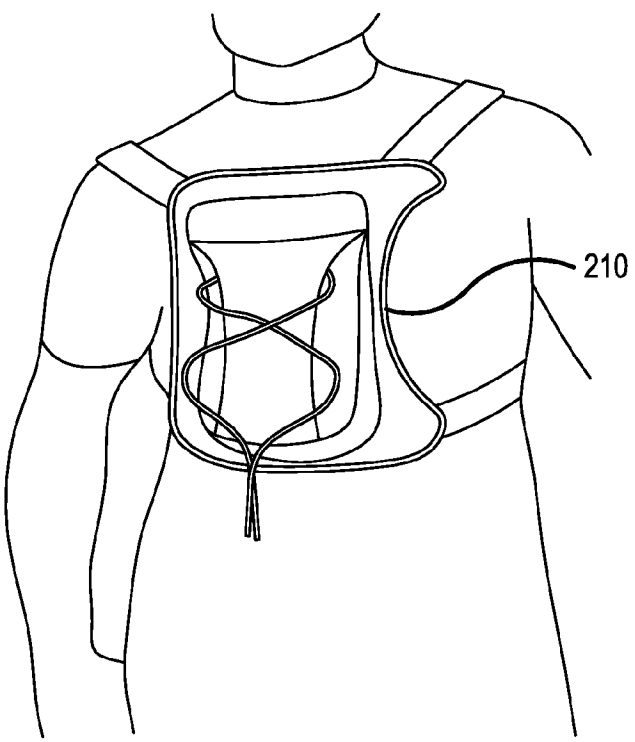
Figures 1, 2C:
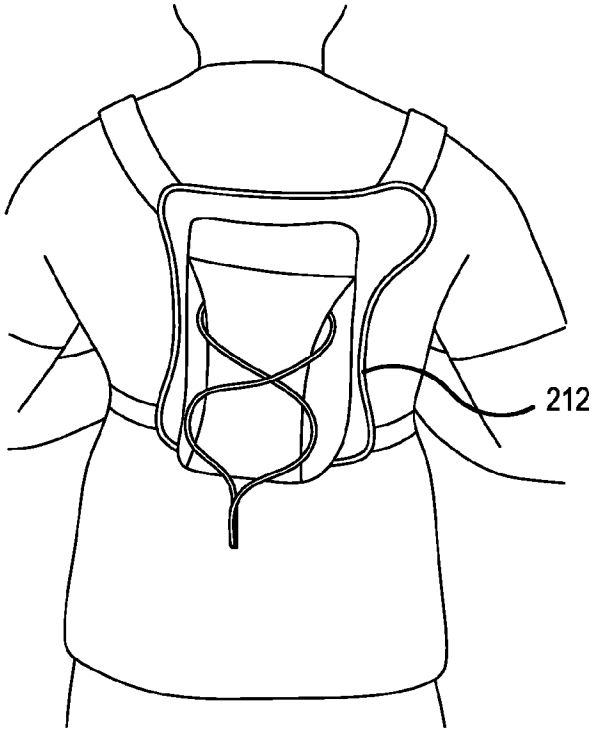

Referring now to FIGS. 2A and 2C-2 different ways by which bag apparatus 100 could be carried by a user 200 are shown according to aspects of embodiments of the present invention. As seen, curved ends 112A through 112D of bag apparatus 100 enable bag apparatus 100 to hug around the contours of a user 200's body. This configuration helps distribute the weight of bag apparatus 100 along with any contents.

In an aspect of an embodiment of the present invention, second detachable strap 120 of bag apparatus 100 may be adjustable to enable weight distribution and comfortable placement of bag apparatus 100. For instance, upon an appropriate extension of second detachable strap 120, bag apparatus 100 will be able to be located around or slightly above thigh 202 of user 200. At this height/location, first detachable strap 116 may be fastened around user 200's thigh 202 with bag apparatus 100 thereby "hugging" the user's thigh. In locating bag apparatus 100 at user 200's thigh 202 and by extending second detachable strap 120 to do so, the weight of bag apparatus 100 (and its contents, if loaded) is effectively distributed thereby alleviating stress or weight on the user's shoulders as experienced by users of contemporary bag systems. In another aspect of an embodiment of the present invention, bag apparatus 100, may, by adjusting second detachable strap 120 be carried around user 200's shoulder 204, waist 206, neck 208, chest 210 or back 212. FIGS. 2C-1 and 2C-2 illustrate the bag apparatus positioned on the back 212 and chest 210 of the user.

The invention has been described in detail with particular reference to certain preferred embodiments thereof, but it will be understood that variations and modifications can be effected within the spirit and scope of the invention.

What is claimed is:

1. A bag apparatus, comprising:

a main body bordered by a slightly rounded base portion, a top portion, opposite the base portion, wherein the top portion is concave in shape, a first side portion between the base and top portions and a second side portion, opposite the first side portion wherein both the first and second side portions have oppositely concave shapes;

a first curved end, extending away from the main body, wherein the first curved end is formed by a first portion of the base portion and a lower portion of the first side portion of the apparatus;

a second curved end, extending away from the main body, wherein the second curved end is formed by a second portion of the base portion and a lower portion of the second side portion of the apparatus;

a third curved end, extending away from the main body, wherein the third curved end is formed by a first portion of the top portion and the upper portion of the first side portion;

a fourth curved end, wherein the fourth curved end is formed by a second portion of the top portion and an upper portion of the second side portion, wherein the fourth curved end extends further away from the main body than any of the first, second or third curved ends; and a compartment portion, superimposedly attached to the main body, wherein the compartment portion comprises of at least one compartment and wherein the compartment portion is any one of: permanently or detachably attached, to the main body.

2. The bag apparatus of claim 1, wherein the ends are convex in shape.

3. The bag apparatus of claim 1, wherein the ends are rounded.

4. The bag apparatus of claim 1, further comprising a first detachable strap having ends that are attached at the first and second curved ends.

5. The bag apparatus of claim 1, wherein the at least one compartment comprises of a closing flap.

6. The bag apparatus of claim 1, wherein the at least one compartment comprises of a closing zipper.

7. The bag apparatus of claim 1 wherein the compartment portion is detachable from the main body.

8. The bag apparatus of claim 1 further comprising of a releasably detachable section of the compartment portion.

9. The bag apparatus of claim 8 wherein the releasably detachable section is attached within a pouch of the compartment portion.

10. The bag apparatus of claim 1 further comprising of a flash light holder.

11. The bag apparatus of claim 1, further comprising a first detachable strap having two ends, wherein each end is attached to an anchor fixed at each of the first and second curved ends.

12. The bag apparatus of claim 11 further comprising of a second detachable strap comprising of two sub-straps with the first sub-straps having an end capable of being attached at the third curved end and the second sub-strap having an end capable of being attached to the fourth curved end, wherein both sub-straps are releasably connected with each other with a connector.

13. The bag apparatus of claim 12 wherein the second detachable strap is adjustable to enable weight distribution and comfortable placement of the bag apparatus.

* * * * *